US005692846A

United States Patent [19]

Schwarzberg

[11] Patent Number: 5,692,846

[45] Date of Patent: Dec. 2, 1997

[54] PUSH-BUTTON APPLICATOR DEVICE FOR DISPENSING LIQUIDS

[75] Inventor: Renate Schattauer Schwarzberg, Barcelona, Spain

[73] Assignee: Artebel, S.L., Madrid, Spain

[21] Appl. No.: 619,752

[22] PCT Filed: Jul. 28, 1995

[86] PCT No.: PCT/ES95/00095

§ 371 Date: Mar. 28, 1996

§ 102(e) Date: Mar. 28, 1996

[87] PCT Pub. No.: WO96/03335

PCT Pub. Date: Feb. 8, 1996

[30] Foreign Application Priority Data

Jul. 28, 1994 [ES] Spain ..... 9402064 U

[51] Int. Cl.[6] ..... A47L 13/17; B05C 1/00

[52] U.S. Cl. ..... 401/190; 401/205

[58] Field of Search ..... 401/190, 205, 401/206

[56] References Cited

U.S. PATENT DOCUMENTS

| | | | |
|---|---|---|---|
| 3,093,857 | 6/1963 | Hersh . | |
| 3,256,549 | 6/1966 | Euesque | 401/190 |
| 3,387,911 | 6/1968 | Focht . | |

FOREIGN PATENT DOCUMENTS

| | | | |
|---|---|---|---|
| 037903 | 10/1981 | European Pat. Off. . | |
| 455552 | 11/1991 | European Pat. Off. . | |
| 2571312 | 4/1986 | France . | |
| 2607752 | 6/1988 | France . | |
| 1927400 | 12/1969 | Germany . | |
| 2017009 | 10/1971 | Germany | 401/190 |

*Primary Examiner*—Steven A. Bratlie
*Attorney, Agent, or Firm*—Klauber & Jackson

[57] ABSTRACT

Push-button applicator device for dispensing liquids intended to be mounted on a dosing pump or aerosol valve on the mouth of liquid containers, and to provide for the dispensing of liquids in a uniform and controlled way on a surface through the use of a spongy material part, and wherein the inadvertent operation of the dosing pump is prevented during storage. The device includes a fixed part (7) which is mounted on a dosing pump (8) or aerosol valve on the neck of the liquid container (10). The free end of the fixed part surrounds the whole periphery of the discharge tube (17) which emerges from the pump. A movable part (4) is adapted for mounting both to the discharge tube of the pump and to the upper end of the fixed part (7). The movable part can be moved towards the container in order to actuate the dosing pump of the container from which liquid is discharged towards a sponge (2), which is covered by a closure cap (1), which preferably does not contact the sponge, and which is mounted to the fixed part (7).

4 Claims, 1 Drawing Sheet

PUSH-BUTTON APPLICATOR DEVICE FOR DISPENSING LIQUIDS

BACKGROUND OF THE INVENTION

The present invention relates to a push-button applicator device for dispensing liquids which can be coupled with a dosing pump or aerosol valve on the mouth of a liquid container, the device allowing dispensing of liquids in a uniform and controlled way on a surface by a spongy material portion, thereby providing a safe system which can prevent spilling of the liquid during transport and storage.

DESCRIPTION OF THE RELATED ART

Applicators with sponges are normally used with liquid products, typically for cleaning and preserving footwear and eyeglasses, wherein a uniform dispensing of the same on a desired surface is required.

A push-button applicator device for dispensing liquids, including devices which are mounted on the dosing pump or aerosol valve located at the mouth of a liquid container, is put forth, for example in EP 0 374 339 B1, wherein the push-button applicator disclosed is mounted on the discharge tube of a dosing pump. The applicator comprises a spongy material part fixed to the top surface of a push button and a peripheral skirt which starts from a top surface and extends towards the container in such a way that, during operation, the push-button applicator slides perimetrically over the neck of the pump-container unit to which it is coupled. The applicator does not become detached due to a ring-shaped widening disposed therein. The spongy material part of the push button is protected by a closure cap that adjusts directly on the push button.

The push button described in EP 0 374 339 B1 moves toward the container upon being pressed upon, whether or not the closure cap is in place, thus actuating the tube which emerges from the dosing pump, whereby a liquid discharge impregnates the top applicator sponge. With this type of push-button applicator, any accidental pressure exerted on the closure cap during transport or storage, e.g., in a bag, is passed on to the discharge tube of the dosing pump and thereby causes inadvertent operation of the same, with the subsequent risk of losses of product and damage to objects and places where the uncontrolled spilling occurs.

SUMMARY OF THE INVENTION

The present invention seeks to overcome the above inconveniences and disadvantages by providing a push-button applicator device for dispensing liquids. The present invention comprises a push-button applicator device for dispensing a liquid from a container (10) having a mouth, a liquid outlet means (8) disposed at the mouth, the mouth being enclosed by the liquid outlet means (8), the liquid outlet means including a discharge tube (17) that extends from the liquid outlet means (8), the discharge tube (17) being displaceable between a first position corresponding to a closed state and a second position corresponding to a discharge state. The push-button applicator device includes at least one fixed part (7), a movable part (4), and a cap (1).

The at least one fixed part (7) includes a proximal portion including fixing means for attaching the fixed part (7) to the liquid outlet means (8) by clasping the liquid outlet means (8) horizontally, the proximal portion having a second outside diameter, and a distal portion which perimetrically surrounds the entire length of the discharge tube (17) when the discharge tube is in the first position, the distal portion having a third diameter.

The movable part (4) is adapted for telescopic movement with respect to the fixed part (7) between the first position and the second position. The movable part (4) includes a proximal portion having a second outside diameter; a distal portion comprising a flat distal surface (3); a spongy material part (2) adhered to the flat distal surface (3); a perimetric skirt (5) extending in a proximal direction from the flat distal surface (3), the perimetric skirt (5) having a first outside diameter, wherein the first outside diameter is smaller than the second outside diameter of the proximal portion of the fixed part (7), and wherein the third diameter is smaller than the first outside diameter of the perimetric skirt (5); and a tube-shaped axial extension (6) extending in a proximal direction from the flat distal surface (3)

The tube-shaped axial extension includes a contiguous outer surface (13), a proximal portion, and means for engaging the discharge tube (17) of the liquid outlet means (8).

The movable part (4) and the discharge tube (17) are capable of moving together between the first and second positions, whereby the movable part (4) provides push-button operation for the liquid outlet means (8). The tube-shaped axial extension (6) is provided with a center channel (11) for conducting the discharge of the liquid. The distal portion of the fixed part (7) directly surrounds the proximal portion of the tube-shaped axial extension (6) when the movable part (4) is in the first position. The movable part (4) is provided with an inside cavity (12) defined between the perimetric skirt (5) and the contiguous outer surface (13) of the tube-shaped axial extension (6). The distal portion of the fixed part (7) is housed in the inside cavity (12) and attaches the movable part (4) to the fixed part (7), whereby the inside cavity (12) guides the movement of the movable part (4) between the first and the second positions.

The cap (1) includes means for engaging the proximal portion of the fixed part (7), whereby the cap, when engaged with the fixed part, completely isolates the movable part (4), thereby preventing the movable part (4) from being accidentally displaced after the cap is applied.

Thus, a primary advantage offered by the present invention comprises preventing inadvertent operation of the dosing pump during transport or storage, e.g. in a bag, by virtue of the fact that the closure cap is mounted on a fixed part that experiences no axial movement, wherein the closure cap is not mounted on the movable part that actuates the push button. Furthermore, the detachment of the applicator part from the rest of the container is prevented due to the fact that the part where the applicator sponge is located is fixedly attached to the fixed part that clasps the mouth of the container.

Another advantage of the present invention consists in the prevention of lateral inclination of the applicator. Another additional advantage of the present invention is that the device can be easily adapted to couple with different shapes and volumes of dosing pumps that are available on the marker in a large number of varieties, and can accommodate the different various ways in which pumps are connected to the mouth of the container, such as by simple fastening, embossment, clamping or threading.

DETAILED DESCRIPTION OF THE PREFERRED EMBODIMENTS

Figure 1:
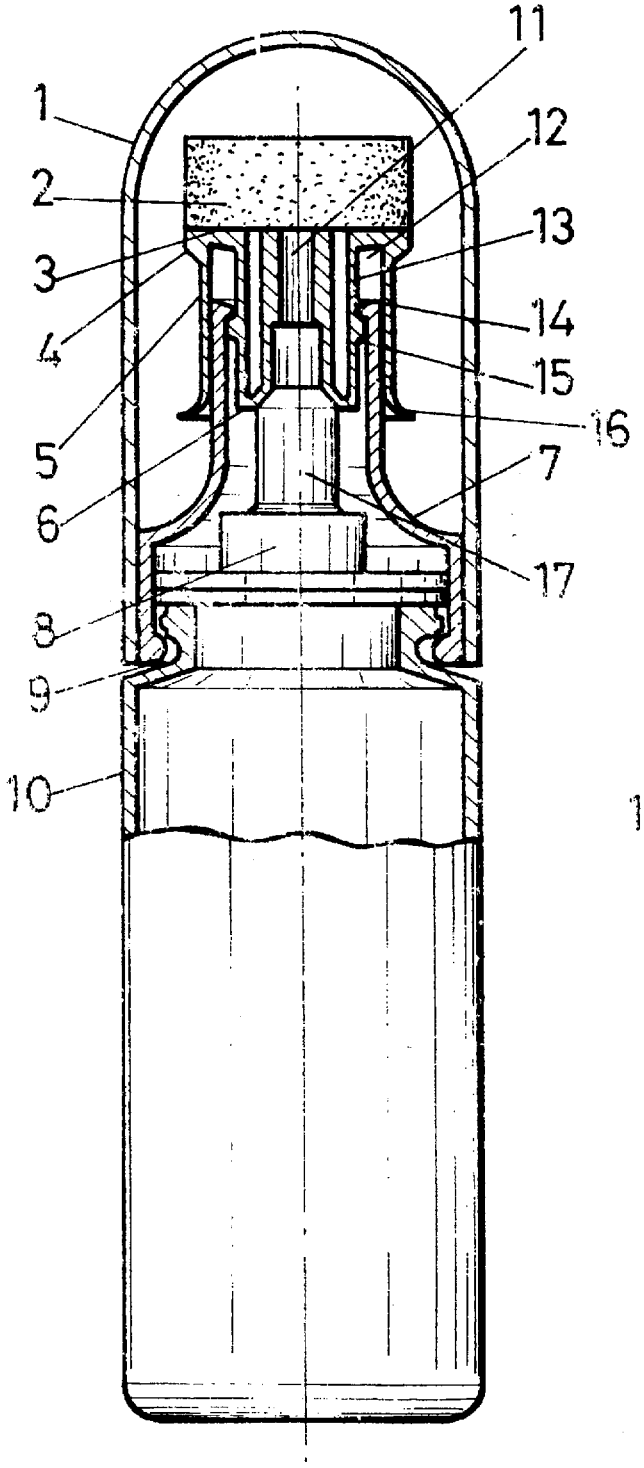
FIG. 1 is an elevational view of a container, to which a dosing pump and a push-button applicator device for dispensing liquids in accordance with the invention have been coupled, the device being sectioned diametrically in a vertical direction and the dosing pump and mouth of the container appearing partially sectioned.

The preferred embodiment of the invention is described in detail hereinafter, with reference to the drawings that only illustrate this specific embodiment.

Movable part 4 includes a top portion having a flat surface 3. A spongy material part 2 is fixedly adhered to a flat surface 3. Movable part 4 is provided with center channel 11 that starts at flat surface 3 and extends downward through a tube-shaped axial extension 6 of the top portion of movable part 4. The tube-shaped axial extension 6 has a double wall, wherein the bottoms of both walls are connected a bottom tube-shaped end portion. The exterior of the bottom tube-shaped end portion is adapted to accommodate the discharge tube 17 of a dosing pump 8. Peripheral skirt 3 extends downward from the top surface 3 of movable part 4.

Fixed part 7 is mounted on the mouth of a container 10, wherein dosing pump 8 is disposed within the fixed part 7. Fixed part 7 remains attached to the mouth of a container 10 by means of a ring-shaped widening 9 disposed inside fixed part 7, or an inwardly extending ring-shaped flange 9, for preventing detachment of the fixed part 7 after mounting on container 10. Thus, fixed part 7 perimetrically surrounds the closure of the container 10 made by the dosing pump 8. Thus, pump 8 is secured by fixed part 7 on the mouth of the container 10, and this securement may optionally be supplemented by means of inside vertical ribs (not shown) placed radially on the periphery of the oblique part of the fixed part 7.

One end, the bottom end, of the fixed part 7 clasps the mouth of the container 10, while the other end, the top end, surrounds the entire length of the sides of the discharge tube 17 which emerges from the dosing pump 8. Movable part 4 has an inside cavity 12 having a cylindrical ring shape and which is delimited axially between the perimetric skirt 5 and the outermost wall of the tube-shaped axial extension 6. The top end of the fixed part 7 is disposed in cavity 12, wherein the cavity 12 forms a guide path for movement of the movable part 4 toward and away from fixed part 7, and wherein movable part 4 always overlaps the fixed part 7, thereby providing an appreciable cylindrical surface between the inside of movable part 4 and fixed part 7, thereby preventing the lateral inclination of the movable part 4.

The resulting assembly between the movable part 4 and the top end of the fixed part 7 which defines cavity 12 also prevents the detachment of the movable part 4 by means of a perimetric edge 14 of the fixed part 7 and another perimetric edge 15 of the movable part.

Thus, the bottom end of the fixed part 7, opposite to the top end which clasps the mouth of the container 10 surrounds sideways the entire length of the discharge tube 17 emerging from the dosing pump 8. This feature, together with the coupling between the applicator part and the fixed part 7 prevents the lateral inclination of the applicator part during use because any force exerted on the applicator part in a non-axial direction and tending to produce an inclination of the same, is absorbed by the fixed part 7 that clasps the mouth of the container 10, thereby preventing the force from being passed on to the discharge tube of the pump, which would otherwise hamper the normal operation of the pump and, in an extreme case, could cause the discharge tube to break.

The perimetric skin 5 of the movable part 4 has in its base a diametric widening that defines a projecting oblique outside surface 16 that facilitates placement of the thumb and index finger when the movable part 4 is axially displaced towards the container 10. The movable part 4 simultaneously presses upon the discharge tube 17 that actuates the dosing pump 8, and a discharge of the liquid is directed through channel 11 towards the top sponge 2.

Figure 2:
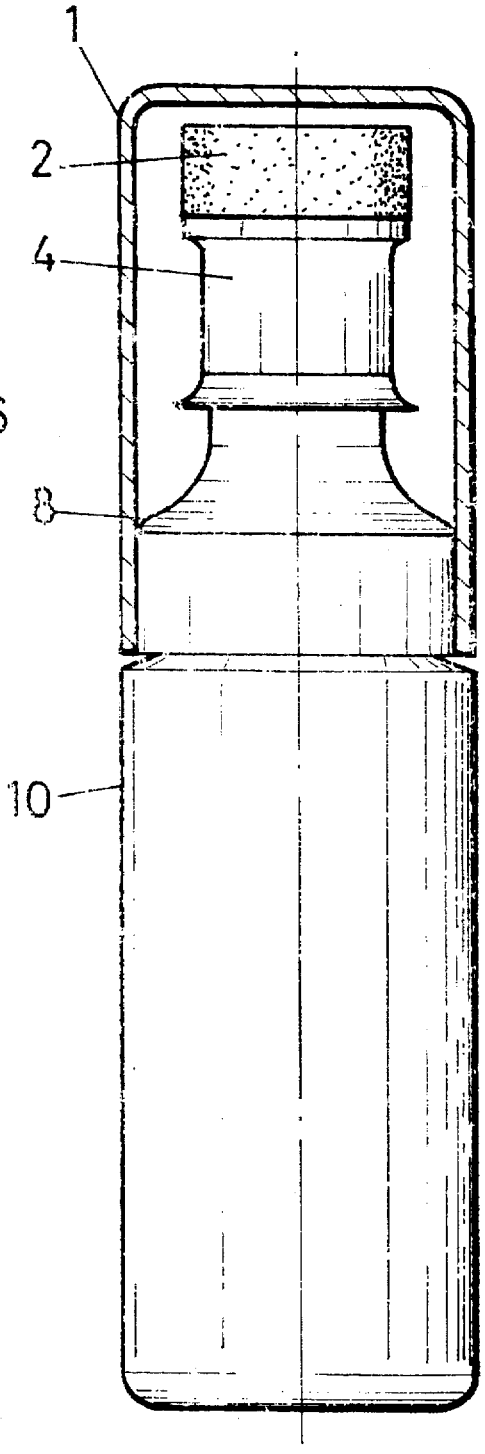
FIG. 2 is the same view as FIG. 1, in which only the closure cap of the push-button applicator device for dispensing liquids is sectioned in this representation.

Movable part 4 is totally protected when not in use by a closure cap 1 as represented in FIGS. 1–2. The closure cap 1 can have different shapes. The closure cap 1 adjusts vertically on the outside surface of the fixed part 7. When the closure cap 1 is mounted to the fixed part 7, operation of the dosing pump 8 is prevented.

The bottom part of tube-shaped axial extension 6 has a slight inside conicity to facilitate entry during coupling of the discharge tube 17 of the dosing pump 8. During coupling, the discharge tube 17 penetrates tube-shaped axial extension 6 until it engages an area of the tube-shaped axial extension 6 with a smaller diameter.

I claim:

1. Push-button applicator device for dispensing a liquid from a container (10) having a mouth, a liquid outlet means (8) disposed at said mouth, said mouth being enclosed by said liquid outlet means (8), said liquid outlet means including a discharge tube (17) that extends from said liquid outlet means (8), said discharge tube (17) being displaceable between a first position corresponding to a closed state and a second position corresponding to a discharge state, said device comprising:

at least one fixed part (7) including:

a proximal portion including fixing means for attaching said fixed part (7) to said liquid outlet means (8) by clasping said liquid outlet means (8) horizontally, said proximal portion having a second outside diameter; and a distal portion which perimetrically surrounds the entire length of said discharge tube (17) when said discharge tube is in said first position, said distal portion having a third diameter;

a movable part (4) adapted for telescopic movement with respect to said fixed part (7) between said first position and said second position, wherein said movable part (4) includes:

a proximal portion having a second outside diameter;

a distal portion comprising a flat distal surface (3);

a spongy material part (2) adhered to said flat distal surface (3);

a perimetric skirt (5) extending in a proximal direction from said flat distal surface (3), said perimetric skirt (5) having a first outside diameter, wherein said first outside diameter is smaller than said second outside diameter of said proximal portion of said fixed part (7), and wherein said third diameter is smaller than said first outside diameter of said perimetric skirt (5); and a tube-shaped axial extension (6) extending in a proximal direction from said flat distal surface (3), said tube-shaped axial extension including:

a contiguous outer surface (13);

a proximal portion; and means for engaging said discharge tube (17) of said liquid outlet means (8), wherein said movable part (4) and said discharge tube (17) are capable of moving together between said first and second positions, whereby said movable part (4) provides push-button operation for said liquid outlet means (8);

wherein said tube-shaped axial extension (6) is provided with a center channel (11) for conducting the discharge of said liquid;

wherein said distal portion of said fixed part (7) directly surrounds said proximal portion of said tube-shaped axial extension (6) when said movable part (4) is in said first position;

wherein said movable part (4) is provided with an inside cavity (12) defined between said perimetric skirt (5) and said contiguous outer surface (13) of said tube-shaped axial extension (6);

wherein said distal portion of said fixed part (7) is housed in said inside cavity (12) and attaches said movable part (4) to said fixed part (7), whereby said inside cavity (12) guides the movement of said movable part (4) between said first and second positions; and a cap (1) including means for engaging said proximal portion of said fixed part (7), whereby said cap, when engaged with said fixed part, completely isolates said movable part (4), thereby preventing said movable part (4) from being accidentally displaced after said cap is applied.

2. The device according to claim 1 wherein said fixed part (7) further comprises a perimetric edge (14), wherein said movable part (4) further comprises a perimetric edge (15), and wherein said perimetric edges (14, 15) are adapted to engage each other such that said movable part (4) and said fixed part (7) are capable of being inseparably assembled together.

3. The device according to claim 1 wherein said movable part (4) and said fixed part (7) further comprise mating cylindrical surfaces, and wherein at least a portion of said mating cylindrical surfaces always overlap.

4. The device according to claim 1 wherein said fixed part (7) further comprises a perimetric rib (9) which allows said fixed part (7) to be press-fit onto said mouth of said container (10).

* * * * *